US012091945B2

(12) United States Patent
Kumar

(10) Patent No.: US 12,091,945 B2
(45) Date of Patent: Sep. 17, 2024

(54) GRAVEL PACKING WITH BASE PIPE HAVING LIMITED OPEN FLOW AREA

(71) Applicant: Schlumberger Technology Corporation, Sugar Land, TX (US)

(72) Inventor: Amrendra Kumar, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/042,900

(22) PCT Filed: Aug. 30, 2021

(86) PCT No.: PCT/US2021/048157

§ 371 (c)(1),
(2) Date: Feb. 24, 2023

(87) PCT Pub. No.: WO2022/047281

PCT Pub. Date: Mar. 3, 2022

(65) Prior Publication Data

US 2023/0340861 A1 Oct. 26, 2023

Related U.S. Application Data

(60) Provisional application No. 63/072,307, filed on Aug. 31, 2020.

(51) Int. Cl.
*E21B 43/08* (2006.01)
*E21B 43/04* (2006.01)

(52) U.S. Cl.
CPC ..... *E21B 43/08* (2013.01); *E21B 43/04* (2013.01)

(58) Field of Classification Search
CPC ..... E21B 43/08; E21B 43/04
See application file for complete search history.

(56) References Cited

U.S. PATENT DOCUMENTS

| | | | |
|---|---|---|---|
| 2003/0111224 | A1 | 6/2003 | Hailey |
| 2013/0081800 | A1 | 4/2013 | Riisem |
| 2015/0027700 | A1 | 1/2015 | Riisem |
| 2016/0003014 | A1 | 1/2016 | Gano |
| 2017/0342809 | A1 | 11/2017 | Huh |

FOREIGN PATENT DOCUMENTS

WO 2022010668 A1 1/2022

OTHER PUBLICATIONS

International Search Report and Written Opinion issued in the PCT Application PCT/US2021/048157, dated Dec. 16, 2021 (11 pages).

*Primary Examiner* — Catherine Loikith
(74) *Attorney, Agent, or Firm* — Jeffrey D. Frantz

(57) ABSTRACT

A screen assembly includes a base pipe, plurality of joints including a filter layer disposed around the base pipe, a drainage layer between the filter layer and the base pipe, and a drainage layer connector positioned between adjacent joints. The base pipe include base pipe connectors aligned with the drainage layer connectors. A flow path exists from an outer annulus between an open hole and the filter layer of the joints, into the filter layer and the drainage layer, across the drainage layer in a downhole direction, across an annulus between the drainage layer connector and the base pipe, into a portion of the drainage layer corresponding to a bottom-most joint, and into an interior of the base pipe via an open flow area at the bottom-most joint for returning to surface.

13 Claims, 2 Drawing Sheets

GRAVEL PACKING WITH BASE PIPE HAVING LIMITED OPEN FLOW AREA

CROSS REFERENCE TO RELATED APPLICATIONS

The present application is a National Stage of International Application No. PCT/US2021/048157, filed Aug. 30, 2021, which claims priority benefit of U.S. Provisional Application No. 63/072,307, filed Aug. 31, 2020, the entirety of which are incorporated by reference herein and should be considered part of this specification.

BACKGROUND

Gravel packs are used in wells for removing particulates from inflowing hydrocarbon fluids. In a variety of applications, gravel packing is performed in long horizontal wells by pumping gravel suspended in a carrier fluid down the annulus between the wellbore and a screen assembly. The carrier fluid is returned to the surface after depositing the gravel in the wellbore annulus. To return to the surface, the carrier fluid leaks off through the sand control screen, through an open flow area on the base pipe, and into a production tubing, which routes the returning carrier fluid back to the surface. However, if the open flow area on the base pipe is limited, insufficient gravel packing may result due to insufficient leak off of the carrier fluid. Accordingly, there is a need to improve gravel packing operations in screen assemblies having a limited open flow area on the base pipe.

SUMMARY

A screen assembly according to one or more embodiments of the present disclosure includes a base pipe, a plurality of joints including a filter layer disposed around the base pipe, a drainage layer between the filter layer and the base pipe, and a drainage layer connector positioned between adjacent joints. In one or more embodiments of the present disclosure, the base pipe includes base pipe connectors aligned with the drainage layer connectors. In one or more embodiments of the present disclosure, a flow path exists from an outer annulus between an open hole and the filter layer of the joints, into the filter and the drainage layer, across the drainage layer in a downhole direction, across an annulus between the drainage layer connector and the base pipe, into a portion of the drainage layer corresponding to a bottom-most joint of the plurality of joints, and into an interior of the base pipe via an open flow area at the bottom-most joint for returning to surface.

A method according to one or more embodiments of the present disclosure includes running a completion string into a wellbore, the completion string including a screen assembly including a base pipe, a plurality of joints including a filter layer disposed around the base pipe, and a drainage layer between the filter layer and the base pipe. The method according to one or more embodiments of the present disclosure further includes depositing a gravel slurry into an outer annulus between an open hole and the filter layer of the joints, the gravel slurry including gravel and a carrier fluid, and dehydrating the gravel slurry by creating a leak-off flow path for the carrier fluid. According to one or more embodiments of the present disclosure, the leak-off flow path flows from the outer annulus, into the filter layer and the drainage layer, across the drainage layer in a downhole direction, across an annulus between a drainage layer connector positioned between adjacent joints and the base pipe, into a portion of the drainage layer corresponding to a bottom-most joint of the plurality of joints, and into an interior of the base pipe via an open flow area at the bottom-most joint for returning to surface.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
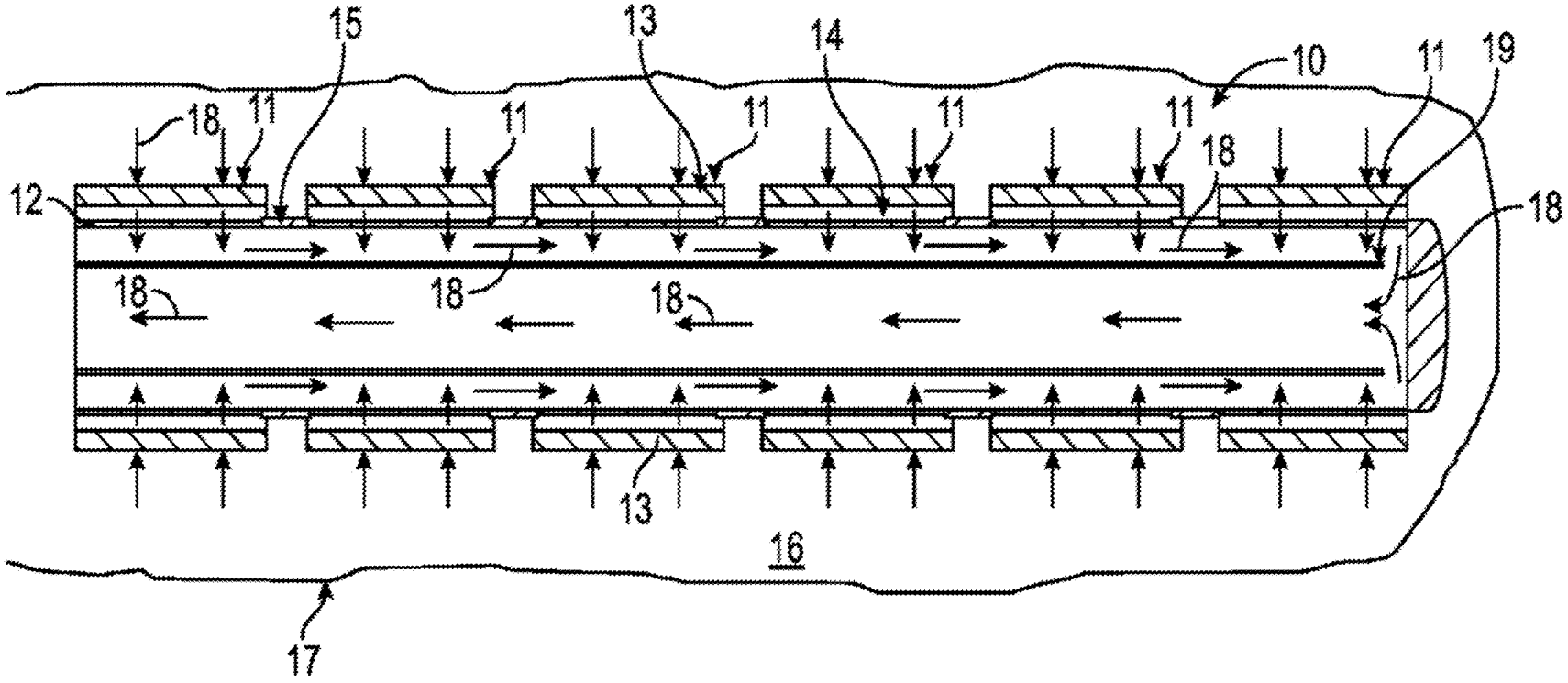
FIG. 1 shows a typical flow path for a gravel packing operation.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally,"

and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

The present disclosure generally relates to a system and method for gravel packing. More specifically, the present disclosure relates to a system and method for gravel packing with a limited open flow area on the base pipe. Gravel packing operations generally require a large open flow area to allow dehydration (i.e., leak-off) and carrier fluid flow back to the surface, which in turn, enables gravel transport and deposition. However, the open flow area on the base pipe may become limited or non-existent when the open flow area is restricted or closed, for example. The system and method according to one or more embodiments of the present disclosure may provide a sufficient flow path for carrier fluid leak-off even when the open flow area on the base pipe is restricted or closed.

Referring now to FIG. 1, a typical flow path for a gravel packing operation is shown. As shown in FIG. 1, the screen assembly 10 includes a plurality of joints 11 and a base pipe 12. Each joint 11 includes a filter layer 13 around the base pipe 12 and a drainage layer 14 between the filter layer 13 and the base pipe 12. Further, the base pipe 12 may include base pipe connectors 15 positioned between adjacent joints 11.

Still referring to FIG. 1, during a typical gravel packing operation, gravel slurry, which may include gravel and a carrier fluid, for example, is deposited into an outer annulus 16 between an open hole 17 and the filter layer 13. Thereafter, the gravel slurry is dehydrated by creating a flow path 18 for the carrier fluid to leak-off through the screen assembly 10. By allowing the carrier fluid to leak-off through the screen assembly 10, gravel remains in the outer annulus 16, creating a gravel pack. FIG. 1 shows the flow path 18 for such a typical gravel packing operation. As shown, the carrier fluid flows from the outer annulus 16 and into the filter layer 13 of the joint 11. Because the base pipe 12 of the screen assembly 10 of the typical gravel packing operation shown in FIG. 1 has an open flow area, the carrier fluid is able to flow through the filter layer 13, into the drainage layer 14, and into the base pipe 12 via the open flow areas all along the base pipe 12, for example. That is, in a typical gravel packing operation, the flow path 18 of the carrier fluid exists within the base pipe 12 in the downhole direction. The carrier fluid flows downhole within the base pipe 12, until the carrier fluid is able to enter the interior of a wash pipe 19 or other inner string installed within the base pipe 12 for returning to surface.

Figure 2:
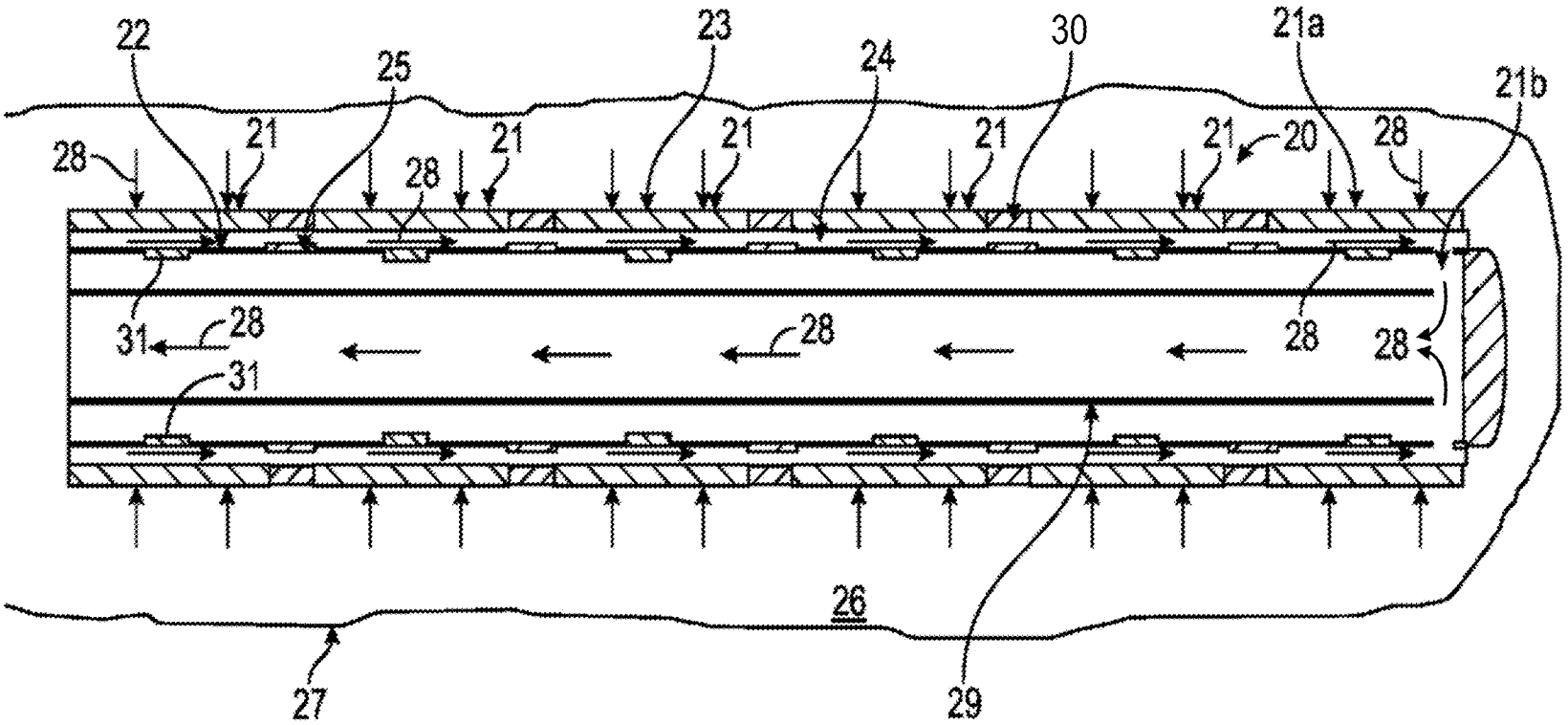
FIG. 2 shows a flow path for a gravel packing operation in accordance with one or more embodiments of the present disclosure.

Referring now to FIG. 2, a flow path for a gravel packing operation in accordance with one or more embodiments of the present disclosure is shown. As shown in FIG. 2, the screen assembly 20 according to one or more embodiments of the present disclosure includes a base pipe 22, a plurality of joints 21 including a filter layer 23 disposed around the base pipe 22, and a drainage layer 24 between the filter layer 23 and the base pipe 22. In one or more embodiments of the present disclosure, the screen assembly 20 also includes a drainage layer connector 30 positioned between adjacent joints 21. Further, the base pipe 22 may include base pipe connectors 25 to facilitate connecting the base pipe 22 within the screen assembly 20. In one or more embodiments of the present disclosure, the base pipe connectors 25 may be aligned with the drainage layer connectors 30.

Still referring to FIG. 2, during a gravel packing operation according to one or more embodiments of the present disclosure, gravel slurry, which may include gravel and a carrier fluid, for example, is deposited into an outer annulus 26 between an open hole 27 and the filter layer 23 of the joints 21. Thereafter, the gravel slurry is dehydrated by creating a flow path 28 for the carrier fluid to leak-off through the screen assembly 20. By allowing the carrier fluid to leak-off through the screen assembly 20, gravel remains in the outer annulus 26, creating a gravel pack.

FIG. 2 shows the flow path 28 for a gravel packing operation according to one or more embodiments of the present disclosure. As shown, the carrier fluid flows from the outer annulus 26 and into the filter layer 23 and the drainage layer 24. The carrier fluid then flows across the drainage layer 24 and an annulus between the drainage layer connector 30 and the base pipe 22. In one or more embodiments of the present disclosure, the drainage layer connector 30 may be a cylindrical pipe, a filter layer, a shunt tube (e.g., transport tube, packing tube, jumper tube, etc.), or any other type of conduit that facilitates the flow of the carrier fluid through filter layer 23 of the screen assembly 20. In one or more embodiments of the present disclosure, the drainage layer connector 30 may be inside or outside the base pipe 22. In one or more embodiments of the present disclosure, the flow path 28 of the carrier fluid then flows into and across the drainage layer 24 in a downhole direction until the flow path 28 reaches a portion of the drainage layer 24 corresponding to a bottom-most joint 21*a* of the plurality of joints 21. Thereafter, the carrier fluid then flows into the interior of the base pipe 22 via an open flow area 21*b* at the bottom-most joint 21*a* for returning to surface. In one or more embodiments of the present disclosure, the bottom-most joint 21*a* of the plurality of joints 21 may be a bottom-most filter layer, or a solid pipe, for example. According to one or more embodiments of the present disclosure, and in contrast to typical gravel packing operations, the flow path 28 of the carrier fluid does not exist within the base pipe 22 in the downhole direction.

In one or more embodiments of the present disclosure, an inner string 29 may be installed inside the base pipe 22, and the flow path 28 of the carrier fluid may flow within the inner string 29 for returning to the surface. In one or more embodiments of the present disclosure, the inner string 29 may be a wash pipe, for example.

According to one or more embodiments of the present disclosure, at least one portion of the base pipe 22 uphole of the open flow area 21*b* at the bottom-most joint 21*a* may include at least one of a blank pipe, a restricted flow area, an open flow area that is closed (e.g., with a sliding sleeve, a valve, etc.), and at least one inflow control device or other type of restriction 31. That is, because the base pipe 22 uphole of the open flow area 21*b* at the bottom-most joint 21*a* is able to accommodate very little to no flow of carrier fluid therethrough, the flow path 28 of the carrier fluid is confined to flowing through the filter layer 23, the drainage layer 24, and the annulus between the drainage layer connectors 30 and the base pipe 22, until reaching the open flow area 21*b* at the bottom-most joint 21*a*. Because the flow path 28 of the carrier fluid is confined in this way, one or more embodiments of the present disclosure advantageously eliminates the need to install the aforementioned inner string 29 inside the base pipe 22 for gravel packing operations.

Advantageously, one or more embodiments of the present disclosure provides sufficient leak-off of carrier fluid during gravel packing operations by way of the filter layer 23, the drainage layer 24, and the annulus between the drainage layer connectors 30 and the base pipe 22, even when there is little to no open flow area in the base pipe 22 of the screen assembly 20. As such, the screen assembly 20 and the associated method according to one or more embodiments of the present disclosure are able to achieve an effective and complete gravel pack for sand control.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A screen assembly, comprising:

a base pipe;

an inner string disposed within the base pipe;

a plurality of joints comprising:

a filter layer disposed around the base pipe and the inner string; and a drainage layer between the filter layer and the base pipe; and a drainage layer connector positioned between adjacent joints, wherein the base pipe comprises a base pipe connector aligned with the drainage layer connector; and a flow path existing from an outer annulus between an open hole and the filter layer of the joints, into the filter layer and the drainage layer, across the drainage layer in a downhole direction, across an annulus between the drainage layer connector and the base pipe, into a portion of the drainage layer corresponding to a bottom-most joint of the plurality of joints, and into an interior of the inner string disposed within the base pipe via an open flow area at the bottom-most joint for returning to surface.

2. The screen assembly of claim 1, wherein the flow path does not exist within the base pipe in the downhole direction.

3. The screen assembly of claim 1, wherein the base pipe is at least one selected from the group consisting of: a blank pipe, a base pipe having a restricted flow area, a base pipe having an open flow area that is closed with a sliding sleeve, and a base pipe comprising at least one inflow control device.

4. The screen assembly of claim 1, wherein the drainage layer connector is at least one selected from the group consisting of: a cylindrical pipe, a filter layer, and a shunt tube.

5. The screen assembly of claim 1, wherein the bottom-most joint of the plurality of joints comprises a bottom-most filter layer.

6. The screen assembly of claim 1, wherein the bottom-most joint of the plurality of joints comprises solid pipe.

7. A method, comprising:

running a completion string into a wellbore, the completion string comprising:

a screen assembly comprising:

a base pipe;

an inner string disposed within the base pipe; and a plurality of joints disposed around the base pipe and the inner string, comprising:

a filter layer disposed around the base pipe; and a drainage layer between the filter layer and the base pipe;

depositing a gravel slurry into an outer annulus between an open hole and the filter layer of the joints, the gravel slurry comprising gravel and a carrier fluid; and dehydrating the gravel slurry by creating a leak-off flow path for the carrier fluid, wherein the leak-off flow path flows from the outer annulus, into the filter layer and the drainage layer, across the drainage layer in a downhole direction, across an annulus between a drainage layer connector positioned between adjacent joints and the base pipe, into a portion of the drainage layer corresponding to a bottom-most joint of the plurality of joints, and into an interior of the inner string disposed within the base pipe via an open flow area at the bottom-most joint for returning to surface.

8. The method of claim 7, wherein the leak-off flow path does not flow within the base pipe in the downhole direction.

9. The method of claim 7, wherein the base pipe is at least one selected from the group consisting of: a blank pipe, a base pipe having a restricted flow area, a base pipe having an open flow area that is closed with a sliding sleeve, and a base pipe comprising at least one inflow control device.

10. The method of claim 7, wherein the drainage layer connector positioned between adjacent joints is at least one selected from the group consisting of: a cylindrical pipe, a filter layer, and a shunt tube.

11. The method of claim 7, wherein the bottom-most joint of the plurality of joints comprises a bottom-most filter layer.

12. The method of claim 7, wherein the bottom-most joint of the plurality of joints comprises solid pipe.

13. The method of claim 7, wherein the base pipe comprises a base pipe connector aligned with the drainage layer connector.

* * * * *